US006689184B1

(12) United States Patent
Morris

(10) Patent No.: US 6,689,184 B1
(45) Date of Patent: Feb. 10, 2004

(54) IRON-BASED POWDERED METAL COMPOSITIONS

(75) Inventor: Robert Craig Morris, Flanders, NJ (US)

(73) Assignee: Latitude Manufacturing Technologies, Inc., Hackettstown, NJ (US)

( * ) Notice: Subject to any disclaimer, the term of this patent is extended or adjusted under 35 U.S.C. 154(b) by 0 days.

(21) Appl. No.: 10/200,094

(22) Filed: Jul. 19, 2002

(51) Int. Cl.[7] ..... C22C 33/02; B22F 1/00
(52) U.S. Cl. ..... 75/246; 75/255; 419/36
(58) Field of Search ..... 419/36; 75/228, 75/255, 246

(56) References Cited

U.S. PATENT DOCUMENTS

| | | | | | |
|---|---|---|---|---|---|
| 4,734,237 | A | | 3/1988 | Fanelli et al. | 264/122 |
| 5,250,254 | A | | 10/1993 | Achikita et al. | 419/37 |
| 5,258,155 | A | | 11/1993 | Sekido et al. | 264/109 |
| 5,286,767 | A | | 2/1994 | Rohrbach et al. | 524/27 |
| 5,397,520 | A | * | 3/1995 | Rohrback et al. | 264/122 |
| 5,602,197 | A | * | 2/1997 | Johnson et al. | 524/275 |
| 5,746,957 | A | * | 5/1998 | Fanelli et al. | 264/109 |
| 5,925,308 | A | * | 7/1999 | Fewkes et al. | 264/623 |
| 5,972,284 | A | * | 10/1999 | Lindsten et al. | 419/2 |
| 5,985,208 | A | | 11/1999 | Zedalis et al. | 419/36 |
| 5,989,493 | A | * | 11/1999 | La Salle et al. | 419/36 |
| 6,261,336 | B1 | * | 7/2001 | Behi et al. | 75/246 |
| 6,261,496 | B1 | * | 7/2001 | Duyckinck et al. | 264/118 |
| 6,268,412 | B1 | | 7/2001 | Zedalis et al. | 524/27 |
| 6,291,560 | B1 | * | 9/2001 | Behi et al. | 524/27 |
| 6,309,573 | B1 | * | 10/2001 | Schoonover et al. | 264/109 |
| 6,328,918 | B1 | * | 12/2001 | Schoonover et al. | 264/109 |

OTHER PUBLICATIONS

"Metals Handbook" vol. 1, 8$^{th}$ Ed., American Society For Metals, Metals Park, Ohio, p. 257 and p. 279 (1961).

M. Pourbaix, "Atlas of Electrochemical Equilibria in Aqueous Solutions", Pergammon Press, New York, p. 311–312 (1966).

"MPIF Standard 35: Materials Standards For P/M Structural Parts", Metal Powder Industries Federation, Princeton NJ 1997.

* cited by examiner

*Primary Examiner*—Daniel J. Jenkins
(74) *Attorney, Agent, or Firm*—Sheldon Kavesh

(57) ABSTRACT

Molding compositions and forming processes for normally rust-prone iron-based powders, and articles produced therefrom. Metal alloy systems that can be successfully formed using the processes of the invention, include elemental iron and iron alloys including low and medium alloy steels, tool steels and a number of specialty iron-base alloys.

26 Claims, 3 Drawing Sheets

IRON-BASED POWDERED METAL COMPOSITIONS

BACKGROUND OF THE INVENTION

1. Field of the Invention

This invention relates to molding compositions and forming processes for normally rust-prone iron-based powders, and articles produced therefrom. Metal alloy systems that can be successfully formed using the processes of the invention, include elemental iron and iron alloys including low and medium alloy steels, tool steels and a number of specialty iron-base alloys.

2. Description of the Related Art

The prototypical process for forming metal powders is Metal Injection Molding (MIM). The steps of fabrication of metal or ceramic-metallic (CERMET) parts are the following:

i. Metal and/or ceramic powders are blended with a thermoplastic binder material and shredded or pelletized to create an injection molding feedstock with thermoplastic properties.

ii. The thermoplastic feedstock is injection molded in a fluid state using methods and tools typical of conventional plastic injection molding, and removed from the mold in a solid state.

iii. The "green" state as-molded parts are subjected to thermal and/or chemical processes to remove the binder phase.

iv. The remaining "brown" state metal or CERMET parts are sintered at higher temperatures to effect consolidation and densification of the molded object.

Several methods, processes, and binder systems have previously been described for fabrication of rust prone iron-based metal alloys and CERMET materials containing them. Each of these processes has one or more disadvantages that prevents important applications.

For example, commonly utilized polymer or wax binder MIM processes, such as the methods described by Achikita et al. in U.S. Pat. No. 5,250,254, are limited to small parts, weighing no more than a few hundred grams, and with maximum section thickness of less than 10 millimeters. This limitation is imposed by the difficulties associated with binder removal prior to sintering. The manufacture of larger parts is prevented or rendered uneconomical by dimensional instability, cracking, or simply the long times needed for binder removal from larger and thicker sections. In addition, great care must by taken when using wax or resin binders to avoid an undesirable out-of-specification increase in the carbon content of the alloy as a result of incomplete removal of the hydrocarbon binder phase.

Fanelli et al., in U.S. Pat. No. 4,734,237, disclose agaroid-based aqueous binders for molding of metal and ceramic powders. The development of aqueous-binder molding compositions, including those disclosed by Fanelli et al., has largely removed the part size restrictions imposed by wax and polymer binders since the binder phase in these largely consists of water which is easily removed by evaporation under ambient conditions. In the special case of agar-based binders, the carbon content problem associated with wax and polymer binders is also effectively addressed since the agar component of the binder is largely gasified at relatively low temperatures during the early stages of the sintering cycle. Further reduction in carbon content is easily achieved by employing an oxidizing atmosphere in the early stages of the sintering heat treatment as taught by Zedalis in U.S. Pat. No. 5,985,208. Carbon content can also be reduced by heat treatment in hydrogen.

Borate and polyamine additives to enhance the gel strength of agar-based aqueous binders have been disclosed by Sekido et al. in U.S. Pat. No. 5,258,155, Rohrbach et al. in U.S. Pat. No. 5,286,767 and Fanelli et al. in U.S. Pat. No. 5,746,957.

Zedalis et al., in U.S. Pat. No. 6,268,412, incorporated herein by reference to the extent not incompatible herewith, disclose molding compositions and processing steps for injection molding of non-rust-prone stainless steel articles using water-base agaroid binder systems. Stainless steels, a family of iron-based alloys containing between 10.5 and 28 atomic % chromium, are compatible with water-based binder systems, since the high chromium content confers great resistance to oxidation in the presence of water.

When rust-prone iron-base alloy powders are substituted for the stainless steel powders in the process taught by Zedalis, the resulting molding feedstock is chemically unstable and must be molded and dried within hours or days, or the water will react with the iron-base alloy powder to form rust, thereby substantially altering and degrading the rheological properties, sintering, and shrinkage behavior of the feedstock.

It is commonly observed that ferrous alloys progressively oxidize or rust in the presence of air and moisture. The essential chemistry of rust formation, as described in *The Metals Handbook*, Volume1, $8^{th}$ Edition, published by the American Society for Metals, (1961), p257, follows. In the first step of the reaction, iron reacts with water to form ferrous and hydroxyl ions and hydrogen:

$$Fe+2H_2O=Fe^{++}+2OH^-+H_2 \quad (1)$$

In a second step, oxygen, if present, reacts with the ferrous ions to produce ferric ions which precipitate out of solution as insoluble ferric hydroxide FeO(OH), otherwise known as rust. Since the rust deposit does not form a protective layer, reaction 1 is free to proceed until the metallic iron is consumed or equilibrium is reached.

The equilibrium constant for reaction 1 is:

$$K=[Fe^{++}][OH^-]^2P_{H2} \quad (2)$$

where the square brackets indicate the concentration of the species and $P_{H2}$ is the partial pressure of hydrogen.

Equation 2 suggests that the equilibrium concentration of $Fe^{++}$can be suppressed by increasing the hydroxyl ion concentration, equivalent to increasing the pH, and or increasing the hydrogen partial pressure. Numerous hydroxyl ion sources, including alkali metal hydroxides and carbonates, ammonia, and various organic amines have been used to inhibit rusting of ferrous alloys in applications involving intermittent or continuous exposure to water.

Rusting can be further inhibited by passivation of the exposed ferrous alloy surface. Typically, passivation involves a thin but impervious layer of gamma iron oxide formed, in-situ, by reaction of the iron with oxidizing ions. Pourbaix, in *Atlas of Electrochemical Equilibria in Aqueous Solutions*, Pergamon Press, New York P. 312 (1966), states that passivation of iron is difficult at a pH below 8, relatively easy at a pH above 8 and very easy between pH 10 and 12. Above pH 13, however, iron will corrode by hyperferrate ion formation. Passivation of ferrous alloy surfaces can be accelerated by the deliberate addition of oxidizers to aqueous environments. Nitrite and nitrate salts have been used in this manner as rust-inhibiting additives in cooling water and other process water applications pH buffers, salts formed by reaction of weak acids with strong bases, are frequently employed with nitrite and nitrates to maintain pH in the proper range. The *Metals Handbook*, Vol.1, $8^{th}$ Ed., American Society for Metals, P. 279, 1961 states that sodium nitrate-borate combinations have been used to inhibit corrosion in diesel engine cooling systems and in low pressure, hot water recirculating systems. In this case, sodium borate (formed by reaction of the weak acid $H_3BO_3$ with the strong base NaOH), functions as a pH buffer. In a similar fashion, calcium nitrite is frequently added to concrete formulations to inhibit rusting of embedded steel reinforcing bars. In this case, the required alkaline environment is synergistically provided by the calcium oxide component of the Portland cement concrete.

Behi et al. in U.S. Pat. No. 6,261,336, specifically addressed the problem of rust formation in aqueous injection molding feedstocks containing rust-prone ferrous alloy powders, and taught that these materials can be stabilized against rust formation by the addition of alkaline sodium silicate to the aqueous binder. It was shown by Behi that carbonyl iron powder feedstocks containing appropriate amounts of sodium silicate are somewhat stable against rust formation and attendant hydrogen evolution, and that the stability is further enhanced by the addition of potassium borate. While this was an improvement over unstabilized iron-based aqueous binder feedstocks, experience with the sodium silicate stabilized feedstocks has revealed that the sodium silicate addition unfortunately renders the feedstock pellets tacky and difficult to feed into the barrel of an injection molding machine. Moreover, residual $SiO_2$ and/or iron silicate inclusions, resulting from decomposition of higher loadings of the sodium silicate during sintering, may be undesirable for applications requiring maximum ductility and fatigue resistance in the final sintered steel part.

A need exists for methods enabling molding of rust prone iron-based alloys that avoid the size limitations of the prior art wax and polymer based binders and the processing and ductility limitations of sodium silicate stabilized aqueous binders.

SUMMARY OF THE INVENTION

In one embodiment, the invention is a molding composition comprising at least one metal powder selected from the group consisting of elemental iron, an iron-base alloy containing less than 10 wt. % chromium, and an iron-based intermetallic compound; and a binder comprising a gel forming material, a solvent for said gel forming material; and at least one compound selected from the group consisting of inorganic nitrates and inorganic nitrites.

In another embodiment, the invention is a process comprising the steps of: injecting an aforedescribed molding composition into a mold at a temperature above the gel point of said gel-forming material; cooling said molding composition in the mold to a temperature below the gel point of said gel-forming material to produce a self supporting molded article; removing said article from the mold; substantially removing said solvent from said molded article; and sintering said molded article in a protective atmosphere and under such conditions of time and temperature as are required to produce a final density greater than about 90% of the theoretical density.

In another embodiment, the invention is a process comprising the steps of: feeding an aforedescribed molding composition into an extruder; extruding said molding composition through a shape forming die; cooling at least the surface of said extrudate to a temperature below the gel point of said gel-forming material to produce a shaped article with at least a self supporting skin; substantially removing said solvent from said shaped article; and sintering said shaped article in a protective atmosphere and under such conditions of time and temperature as are required to produce a final density greater than about 90% of the theoretical density.

In yet another embodiment, the invention comprises shaped articles comprising a metal powder selected from the group consisting of elemental iron, an iron-base alloy containing less than 10 wt. % chromium, and an iron-based intermetallic compound produced by one of the aforedescribed processes.

DETAILED DESCRIPTION OF THE INVENTION

Figure 1:
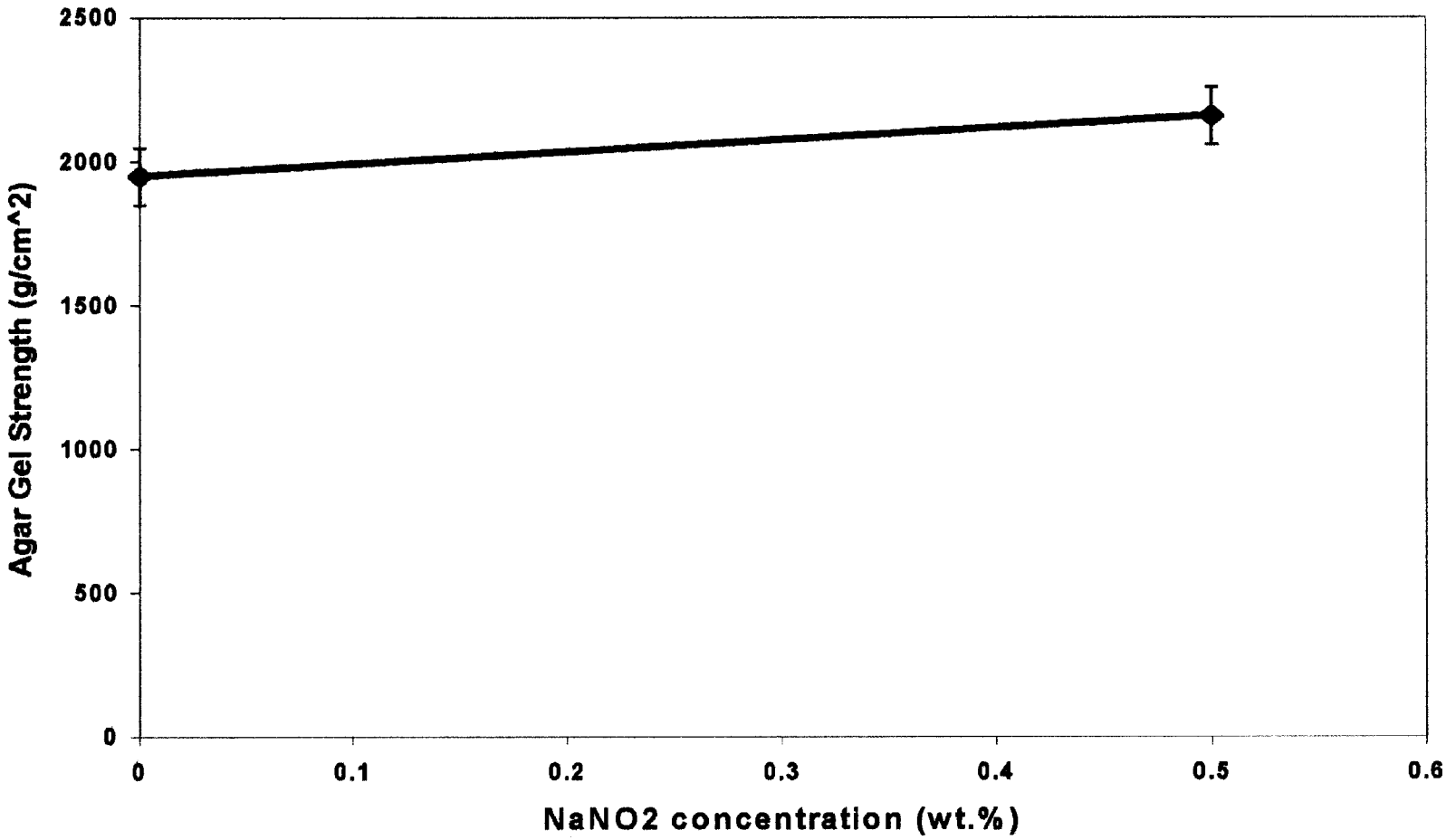
FIG. 1 shows the effect of $NaNO_2$ concentration on the gel strength of 2 wt. % agar.

Iron-base articles are formed according to this invention from normally rust-prone powdered materials. In one embodiment, the invention is a molding composition comprising at least one metal powder selected from the group consisting of elemental iron, an iron-base alloy containing less than 10 wt. % chromium, and an iron-based intermetallic compound; and a binder comprising a gel forming material, a solvent for said gel forming material, and at least one compound selected from the group consisting of inorganic nitrates and inorganic nitrites.

It will be understood that an iron-base alloy or an iron-based intermetallic compound is one in which a plurality of the metal atoms are iron.

Preferably, the metal powder molding composition additionally contains a soluble pH-buffering compound and may contain a ceramic powder.

The powder particles comprising the metal powder molding composition are preferably of a spheroidal shape having a weight average particle size of about 1 to about 50 microns (micrometers). More preferably, the weight average particle size is about 2 to about 20 microns and most preferably about 5 to about 15 microns. In some cases, where maximum solids loading is required, it is desirable to employ powders with a bimodal particle size distribution, for example with one population of particles in the 5–15 micron size range and another population of particles with sizes in the 50–100 micron range. The metal powder particles are also preferably substantially dense and free of trapped gas pockets and voids. The iron-base alloy powder is preferably made by the well-known processes of gas or water atomization, or carbonyl deposition, but other methods of powder manufacture may be used if the preferred ranges of particle size, shape and density are achieved at an acceptable cost.

Some representative standard iron-base alloys, which are normally susceptible to rusting but which, in powder form, can be conveniently compounded and molded using the methods of the invention, are listed in Tables I to III. These Tables are abstracted from *The Metals Handbook*, Volume1, $8^{th}$ Edition, published by the American Society for Metals, (1961). It will be understood that many other standard and specialized iron-base alloys, in addition to those listed in Tables I to III, can also benefit from application of the invention.

TABLE I

Representative Carbon Alloy Steels

| SAE No. | Chemical composition limits for major alloying elements (atomic %) C | Mn | Si | Ni | Cr | Mo |
|---|---|---|---|---|---|---|
| 1010 | 0.08–0.13 | 0.30–0.60 | 0.15–0.35 | — | — | — |
| 1330 | 0.28–0.33 | 1.60–1.90 | 0.15–0.35 | — | — | — |
| 4023 | 0.20–0.25 | 0.70–0.90 | 0.15–0.35 | — | — | — |
| 4024 | 0.20–0.25 | 0.70–0.90 | 0.15–0.35 | — | — | 0.20–0.30 |
| 4130 | 0.28–0.33 | 0.40–0.60 | 0.15–0.35 | — | 0.80–1.10 | 0.15–0.25 |
| 4320 | 0.17–0.22 | 0.45–0.65 | 0.15–0.35 | 1.65–2.00 | 0.40–0.60 | 0.20–0.30 |
| 4817 | 0.15–0.20 | 0.40–0.60 | 0.15–0.35 | 3.25–3.75 | — | 0.20–0.30 |
| 4820 | 0.18–0.23 | 0.50–0.70 | 0.15–0.35 | 3.25–3.75 | — | 0.20–0.30 |
| 9310 | 0.08–0.13 | 0.45–0.65 | 0.15–0.35 | 3.00–3.50 | 1.00–1.40 | 0.08–0.15 |

TABLE II

Representative Tool Steels.

| AISI No. | Chemical composition limits for major alloying elements (atomic %) C | Mn | Si | Cr | Ni | Mo | W | V | Co |
|---|---|---|---|---|---|---|---|---|---|
| | | | | Molybdenum high-speed steels | | | | | |
| M1 | 0.78- | 0.15- | 0.20- | 3.50- | 0.3 | 8.20- | 1.40- | 1.00- | — |
| M30 | 0.75- | 0.15- | 0.20- | 3.50- | 0.3 | 7.75- | 1.30- | 1.00- | 4.50- |
| | | | | Tungsten high speed steels | | | | | |
| T1 | 0.65- | 0.10- | 0.20- | 3.75- | 0.3 | — | 17.25 | 0.90- | — |
| T15 | 1.50- | 0.15- | 0.15- | 3.75- | 0.3 | 1.00 | 11.75 | 4.50- | 4.75- |
| | | | | Intermediate high-speed steels | | | | | |
| M50 | 0.78- | 0.15- | 0.20- | 3.75- | 0.3 | 3.90- | — | 0.80- | — |
| | | | | Chromium hot-work steels | | | | | |
| H10 | 0.35- | 0.25- | 0.80- | 3.00- | 0.3 | 2.00- | — | 0.25- | — |
| H19 | 0.32- | 0.20- | 0.20- | 4.00- | 0.3 | 0.30- | 3.75- | 1.75- | 4.00- |
| | | | | Tungsten hot-work steels | | | | | |
| H21 | 0.26- | 0.15- | 0.15- | 3.00- | 0.30 | — | 8.50- | 0.30- | — |
| H26 | 0.45- | 0.15- | 0.15- | 3.75- | 0.3 | — | 17.25 | 0.75- | — |
| | | | | Molybdenum hot-work steels | | | | | |
| H42 | 0.55- | 0.15- | — | 3.75- | 0.3 | — | 8.50- | 0.30- | — |
| | | | | Air-hardening, medium-alloy cold-work steels | | | | | |
| A2 | 0.95- | 1.00 | 0.50 | 4.75- | 0.3 | 0.90- | — | 0.15- | — |
| A10 | 1.25- | 1.60- | 1.00- | — | 1.55- | 1.25- | — | — | — |
| | | | | High-carbon, high-chromium, cold-work steels | | | | | |
| D2 | 1.40- | 0.60 | 0.60 | 11.00 | 0.3 | 0.70- | — | 1.10 | — |
| D5 | 1.40- | 0.60 | 0.60 | 11.00 | 0.3 | 0.3 | — | 1.00 | 2.50- |
| | | | | Low carbon mold steels | | | | | |
| P4 | 0.10 | 0.20- | 0.40 | 2.00- | 0.35 | — | — | — | — |
| P6 | 0.05- | 0.35- | 0.10- | 1.25- | 3.25- | — | — | — | — |

Other standard alloys within the scope of the invention include Powder Metallurgy (P/M) and Metal Injection Molding (MIM) alloys listed in MPIF Standard 35: Materials Standards For P/M Structural Parts, published by Metal Powder Industries Federation, (1997) and in Materials Standards For Metal Injection Molded Parts, published by Metal Powder Industries Federation, (1993). Such alloy compositions are given in Table III below.

TABLE III

Representative P/M and MIM Alloys

| Material designation | Chemical composition limits for major alloying elements (atomic %) Fe | Ni | C | Mo | Cu |
|---|---|---|---|---|---|
| F-0000 | 97.7–100 | — | 0.0–0.3 | — | — |
| FC-0200 | 93.8–98.5 | — | 0.0–0.3 | | 0.3–0.6 |

TABLE III-continued

Representative P/M and MIM Alloys

| Material designation | Chemical composition limits for major alloying elements (atomic %) Fe | Ni | C | Mo | Cu |
|---|---|---|---|---|---|
| FN-0200 | 92.2–99.0 | 1.0–3.0 | 0–0.3 | — | 0–2.5 |
| FL-4605 | 94.50–97.50 | 1.70–2.00 | 0.40–0.70 | 0.40–0.80 | — |
| FLN-4205 | 93.95–97.75 | 1.35–2.50 | 0.4–0.7 | 0.50–0.85 | — |
| FLN2-4405 | 93.30–97.90 | 1.00–3.00 | 0.4–0.7 | 0.7–1.0 | — |
| FLN4-4405 | 91.30–95.90 | 3.00–5.00 | 0.4–0.7 | 0.7–1.0 | — |
| MIM-4600 | 94.9–98.5 | 1.5–2.5 | 0.0–0.1 | 0.0–0.5 | — |
| MIM-4650 | 94.4–98.1 | 1.5–2.5 | 0.4–0.6 | 0.0–0.5 | — |
| MIM-2700 | 88.9–93.5 | 6.5–8.5 | 0.0–0.1 | 0.0–0.5 | — |

The iron-base metal powders are initially mixed with gel-forming material and a solvent at a temperature sufficient to insure dissolution of the gel-forming material in the solvent. This molding composition is proportioned to be fluid enough to enable it to be readily supplied to a die or mold by any of a variety of techniques, and especially by injection molding or extrusion. Generally, the amount of metal powder in the mixture is about 50 percent to about 96 percent by weight of the mixture. Preferably, the metal powder constitutes about 80 percent to about 95 percent by weight of the mixture, and most preferably constitutes about 90 percent to about 94 percent by weight of the mixture.

The gel-forming material employed in the binder is a material that exhibits a gel strength of at least about 200 g/cm$^2$, measured at a temperature of 23° C. on a gel comprising 1.5 wt % of the gel-forming material in 98.5 wt % solvent. This is the minimum value of gel strength necessary to produce a self-supporting article having sufficient green strength to be handled at ambient temperature without the need for special handling equipment. Preferably gel strength is at least about 400 g/cm$^2$. Higher values of gel strength can be particularly useful in producing parts with complex shapes, thinner cross-sections, and/or higher weights. Furthermore, higher gel strengths may enable the use of smaller amounts of the gel-forming material in the molding composition.

The gel strength of the gel-forming material is measured by using an apparatus commonly employed in the manufacturing of industrial gums. The standard apparatus consists of a rod having a 1 cm$^2$ circular cross section, one end thereof which is suspended above one pan of a twin pan balance. A large container is placed on the other pan of the balance. A smaller container on the pan, above which is suspended the rod, is filled with about 200 ml (volume) of a gel having about 1.5 wt % of the gel-forming material dissolved in a solvent. The empty container is then balanced against the gel-containing container. The rod is then lowered into contact with the top surface of the gel. Water is then metered into the empty container and the position of the balance pointer is continuously monitored. When the top surface of the gel is punctured by the rod, the balance pointer rapidly deflects across the scale and the water feed is immediately discontinued. The mass of water in the container is then measured and the gel strength, weight (force) per unit area, is calculated.

Figure 2:
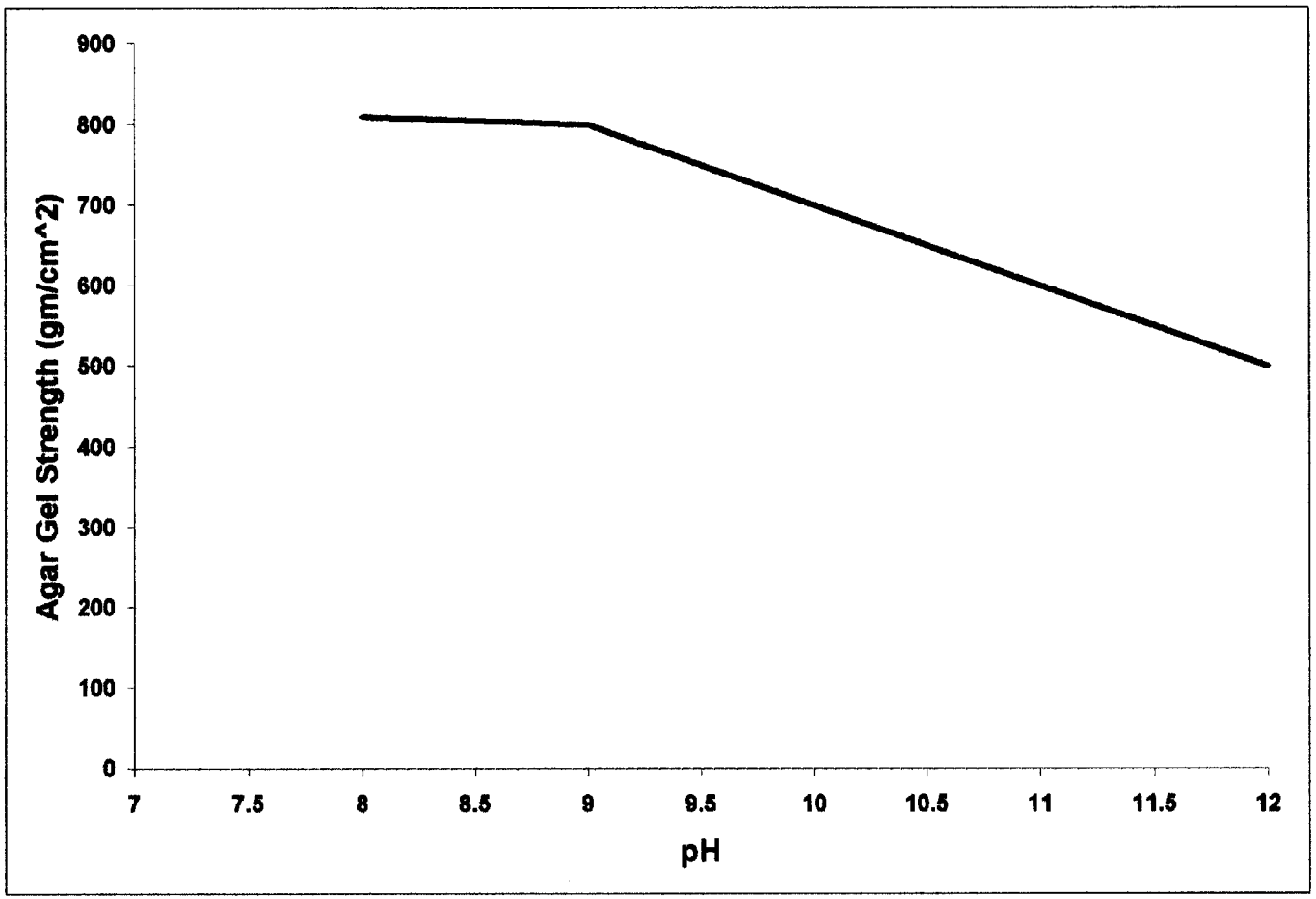
FIG. 2 shows the effect of pH on the gel strength of 1.5 wt. % of a typical food-grade agar.
Figure 3:
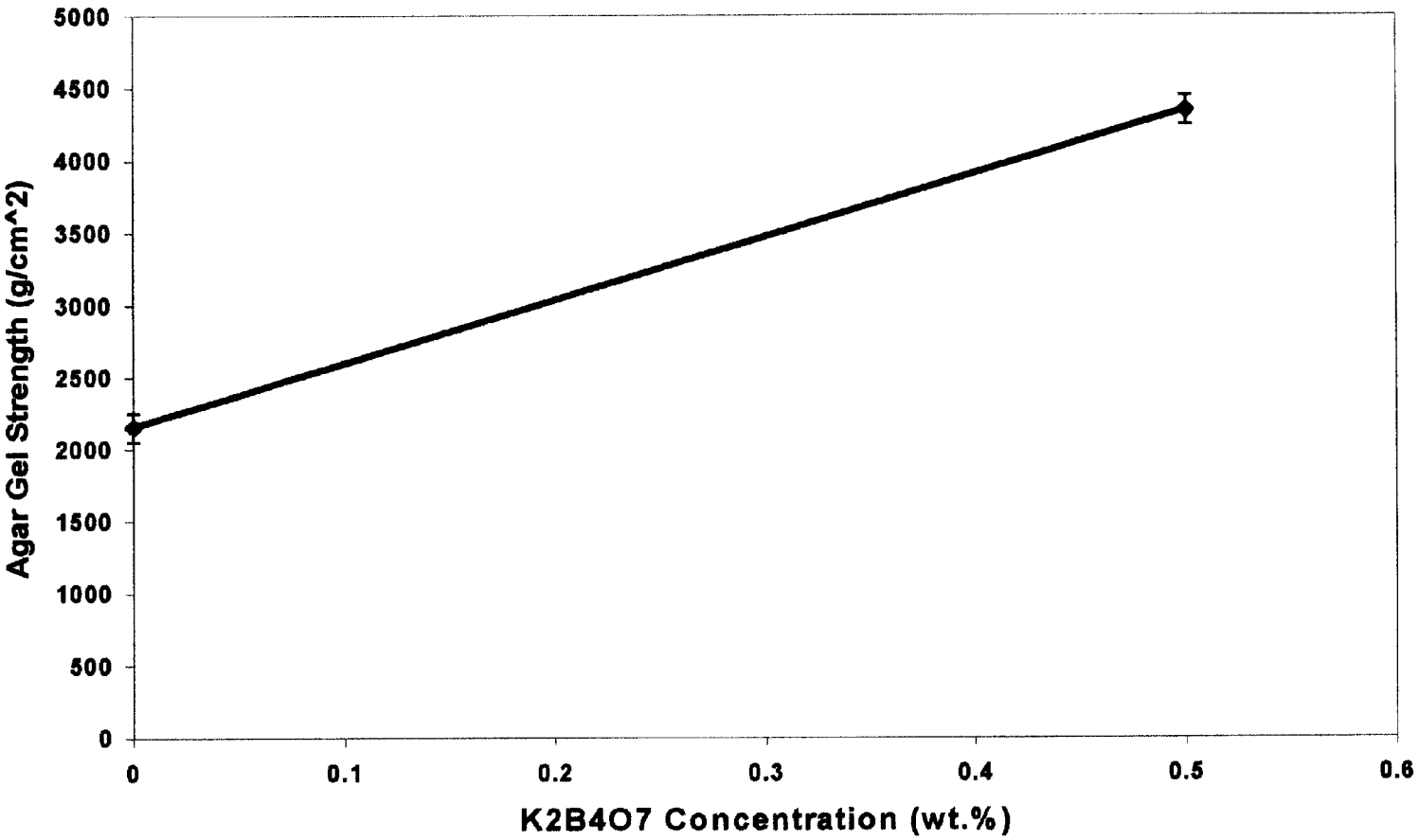
FIG. 3 shows the effect of potassium tetraborate on the gel strength of a 2 wt. % agar gel containing 0.5 wt. % $NaNO_2$.

The gel strength measurements reported herein in FIGS. 1 and 3 were obtained by this general method with the exceptions that the agar concentration was 2% and the indenting rod had a smaller cross-sectional area of 0.0792 $cm^2$ (corresponding to a diameter of 0.125 inches). The measurements reported in FIG. 2 were obtained using a standard 1 $cm^2$ indentor.

Gel forming materials include agaroids, proteins, starches, methyl cellulose and synthetic polymers such as polyvinyl alcohol, polyacrylamide, and polyvinyl pyrrolidone. Preferred gel forming materials are agariods, other natural gums and synthetic water soluble polymers. An agaroid is defined as a gum resembling agar but not meeting all of the characteristics thereof. (See H. H. Selby et al., "Agar," Industrial Gums, Academic Press, New York, N.Y., 2nd ea., 1973, Chapter 3, p. 29). As used herein, however, agaroid not only refers to any gum, resembling agar, but also to agar and derivatives thereof such as agarose. An agaroid is particularly useful because it exhibits rapid gelation within a narrow temperature range, a factor that increases the rate of production of molded articles. The gel point of the gel-forming material is preferably about 10° C. to about 60° C. and most preferably is about 30° C. to about 45° C.

The preferred gel-forming materials are those which are readily water soluble and comprise an agaroid, or more preferably, agar, and the most preferred gel-forming materials consist of agar or agarose.

The gel-forming material is provided in an amount from about 0.2 wt % to about 5 wt % based upon the total solids in the molding composition. More than about 5 wt. % of the gel-forming material may be employed in the molding composition without adverse effects but this increases costs. Most preferably, the gel-forming material comprises between about I percent and about 3 percent by weight of solids in the molding composition.

The solvent for the gel-forming material may be one of a number of polar liquids, including water, low molecular weight alcohols, polyhydric solvents such as ethylene glycol and glycerine, and mixtures thereof, depending upon the composition of the gel-forming material. It is most preferable to employ a solvent that can also provide fluidity to the molding composition at elevated temperature, thus enabling the molding composition to be easily supplied to a mold. Aqueous solvent systems are particularly suited for serving as both solvents for the gel-former and providing the desired rheological properties to the molding composition. Water is also easily removed from the molded body prior to and/or during firing.

Preferred are aqueous solvents containing at least about 50 wt. % water. More preferred are solvents containing 75 wt. % water. Most preferred are aqueous solvents containing at least about 90 wt. % water. Water is the preferred solvent for agaroid and many other gel-forming materials.

Generally, the solvent is about 3 percent to about 50 percent by weight of the molding composition depending upon the viscosity desired. Where the gel-former is an agaroid and the solvent is water, the water is between preferably about 4 percent to about 20 percent by weight of the mixture, with about 5 percent to about 10 percent by weight being more preferred.

However, many iron and iron-base alloy powders react with water in the preferred aqueous binders to form rust. It has been found that the iron and iron-containing powders can be rendered stable against rusting, without adverse effects on gel strength or processibility by incorporation of small amounts of soluble inorganic nitrites or nitrates in the aqueous binder. Preferred inorganic nitrites and nitrates are those of lithium, sodium, potassium, calcium, magnesium, zinc, cobalt, iron, chromium, and copper. The nitrite or nitrate concentration, expressed as a weight percentage of the binder is preferably in the range of from 0.05% to 5.0%, more preferably in the range of from 0.1% to 2.0%, and most preferably in the range of from 0.15% to 1%. Surprisingly, low concentrations of nitrite salts do not degrade the gel strength of agar gels as illustrated in FIG. 1.

The pH of the binder is preferably held in the range of from 7 to 11 and more preferably in the range of from 8.5 to 9.5. Maintaining the pH in this range improves stability against rusting while preserving gel strength. Higher pH would be more beneficial in facilitating iron surface passivation and inhibiting rusting, but could be damaging to gel strength of the preferred agaroid gel forming compounds, FIG. 2 shows the detrimental effect of increasing pH on the gel strength of a typical food grade agar.

Preferably, the metal powder molding composition includes a soluble pH buffering compound. Preferably, the pH buffering compound is at least one borate salt of an alkali metal element, an alkali earth element, or ammonia. Most preferably, the pH buffering compound is a borate salt comprising at least one member selected from the group consisting of the metaborate ($BO_2^-$) or tetraborate ($B_4O_7^{-2}$) salt of lithium, sodium, potassium, magnesium, calcium, strontium, barium, zinc, and ammonium. The borate concentration, expressed as a weight percentage of the binder phase, is preferably of from about 0.05% to about 3.0%, more preferably in the range of from 0.15% to 2.0%, and most preferably in the range of from 0.2% to 1.0%.

Binder pH can be adjusted, for example, by changing the molar ratio of boric acid to base in the borate salt. For example, a 0.5 wt. % solution of potassium tetraborate ($K_2B_4O_7$) in distilled water has a pH of about 9.2 while a 0.5 wt. % solution of potassium metaborate ($KBO_2$) has a pH of about 10.8. Borate salts provide the synergistic benefit of increasing the gel strength of agar-based binders, as illustrated in FIG. 3, which shows the effect of potassium tetraborate on agar gel strength.

Pelletized aqueous agar-binder injection molding feedstocks, containing nitrite or nitrate and borate binder additives do not exhibit any tacky or sticky properties, as have been noted with the sodium silicate stabilized feedstocks disclosed by Behi, and are easily fed by gravity through the hopper of an injection molding machine or extruder. Thus, the nitrite (or nitrate)-borate additive combination is particularly synergistic and beneficial for the production of useful aqueous-binder molding compositions comprising normally rust-prone iron-base alloy powders.

Nitrite and/or nitrate salts and agar can be utilized as nutrients by various bacteria. Bacterial attack of the molding compound during storage could result in loss of corrosion protection, and degradation of the binder strength. Thus, it is important that the molding compound be kept free of bacterial contamination, especially if there is to be a significant storage period between compounding and molding. This can be accomplished either by storage under sterile conditions, since compounding at temperatures approaching 100 degrees C. is expected to produce a sterile as-compounded product, or by the addition of suitable broad spectrum biocides to the formulation, the latter approach being preferred. Preferred biocide additives include benzoate salts such as n propyl p hydroxybenzoate (CAS No. (94-13-3), and methyl p-hydroxy benzoate, also known as Methyl Parabem (CAS No. 99-76-3). These particular biocides are highly effective at concentrations of 0.01–0.5 wt %, based on the water content of the molding compound, and are preferably used in combination to increase the range of bacterial species addressed. Other biocides can also be used provided that they are effective and do not materially degrade the properties or performance of the molding compound.

The molding composition may also contain a variety of other additives, which can serve a number of useful purposes. For example, coupling agents and/or dispersants may be employed to ensure a more homogeneous mixture. Lubricants such as glycerin and other monohydric and polyhydric alcohols may be added to assist in feeding the mixture along the bore of an extruder barrel and/or reduce the vapor pressure of the liquid carrier and enhance the production of the near net shape objects. Small molecule sugars, such as glucose, sucrose, fructose etc., can be used to increase the fluidity of agar-based molding compositions, as described by Behi in U.S. Pat. No. 6,262,150. These fluidizing agents can be used to increase the volume fraction of metal powder in agaroid-based molding compositions leading to reduced shrinkage in the sintering step.

The amount of additives will vary depending on the additive and its function within the system. However, the additives must be controlled to ensure that the gel strength of the gel-forming material is not substantially destroyed. For example, Table IV below shows the deleterious effect on the gel strength of agar in aqueous solution by LICA-38J (Kenrich Petrochemicals, Inc.), an additive that may be used to enhance the processing of the metal powder in the molding formulation.

TABLE IV

Additive Concentration on Agar Gel Strength at 23° C.

| Additive | Agar Weight %: | Gel Strength |
|---|---|---|
| None | 3.85 | 1480 ± 7 g/cm$^2$ |
| 0.95 wt % LICA-38J | 3.80 | 1360 ± 7 g/cm$^2$ |

In another embodiment, the invention is a process comprising the steps of: injecting an aforedescribed molding composition into a mold at a temperature above the gel point of said gel-forming material; cooling said molding composition in the mold to a temperature below the gel point of said gel-forming material to produce a self supporting molded article; removing said article from the mold; substantially removing said solvent from said molded article; and sintering said molded article in a protective atmosphere and under such conditions of time and temperature as are required to produce a final density greater than about 90% of the theoretical density.

In another embodiment, the invention is a process comprising the steps of: feeding an aforedescribed molding composition into an extruder; extruding said molding composition through a shape forming die; cooling at least the surface of said extrudate to a temperature below the gel point of said gel-forming material to produce a shaped article with at least a self supporting skin; substantially removing said solvent from said shaped article; and sintering said shaped article in a protective atmosphere and under such conditions of time and temperature as are required to produce a final density greater than about 90% of the theoretical density.

In yet another embodiment, the invention comprises shaped articles comprising a metal powder selected from the group consisting of elemental iron, an iron-base alloy containing less than 10 wt. % chromium, and an iron-based intermetallic compound produced by one of the aforedescribed processes.

A wide range of molding or extrusion pressures may be employed. Generally, in an injection molding process, the molding composition is delivered to the mold at pressures from about 20 psi (137 kPa) to about 3,500 psi (24 MPa), although higher or lower pressures may be employed depending upon the molding technique used. Most preferably, the molding pressure is in the range of about 100 psi (690 kPa) to about 1500 psi (10 MPa). In an extrusion process, the molding composition is delivered to the shape forming die at pressures of about 20 psi (137

The temperature of the molded or extruded shape, upon removal from the mold or exit from the extrusion die, is preferably at or below the gel point of the gel-forming material at least at its surface. The gel point of the gel-forming material in the present invention is preferably from about 10° C. to about 60° C., and most preferably is from about 30° C. to about 45° C. The mold or die temperature is maintained at less than about 40° C., and is preferably less than about 25° C. The appropriate temperature of the molding composition can be achieved during or after the mixture is a supplied to the mold or die, and especially by cooling in the mold or die.

After the part has been formed and cooled, the green body thus formed, is a self-supporting body, requiring no special handling. It may be dried to substantially remove the solvent before being placed into a sintering furnace or it may be dried in the furnace.

In the furnace, the body is sintered in a reducing atmosphere to produce the final dense product. Before being brought to sintering temperature, the green body may first be heated in air or vacuum to moderate temperatures of about 250° C. to about 600° C. to assist in removal of the small amount of organic matter in the body. The sintering times and temperatures (sintering schedules) are regulated according to the powdered material employed to form the part. Sintering schedules are well known in the art for a multitude of iron-base materials. For example, Zhang and German discuss the sintering of MIM Fe—Ni alloys in *The International Journal of Powder Metallurgy*, 38, pp. 51–61 (2002). The fired products produced by the present invention can be very dense, net or near net shape products.

As noted previously, an advantage of the processes of the present invention over prior art processes for molding of rust-prone iron based alloys is the use of gel forming binders rather than wax and polymer binders such as described in U.S. Pat. No. 5,250,254. The benefits of this binder system include the ability to mold larger and thicker parts and the ability to achieve higher production rates. Usually, the processing temperatures of the molding composition in the present invention are less than 100° C., and typically about 90° C. These temperatures are substantially lower than the temperatures normally required with the wax and polymer binders. Consequently, the gel-forming materials of the present invention require substantially less mold or die cooling.

EXAMPLES

Comparative Example 1

Four 100 cc gel samples containing approximately 2 wt. % of agar were made by combining the following ingredients:

1. 98 grams distilled water; 2 grams TIC PRETESTED® Agar Agar 100 (TIC Gums, Inc., Belcamp, Md.)
2. 97.5 grams distilled water; 2 grams TIC PRETESTED® Agar Agar 100; 0.5 grams potassium nitrite (Alpha Aesar CAS# 7758-09-0)
3. 97 grams distilled water; 2 grams TIC PRETESTED® Agar Agar 100; 0.5 grams potassium nitrite (Alpha Aesar CAS# 7758-09-0); 0.5 grams potassium tetraborate ($K_2B_4O_7$) (Alpha Aesar CAS # 12045-78-2).
4. 97 grams distilled water; 2 grams TIC PRETESTED® Agar Agar 100; 0.5 grams potassium nitrite (Alpha Aesar CAS# 7758-09-0); 0.5 grams potassium metaborate ($KBO_2$) (Alpha Aesar CAS # 16481-66-6).

In each case, the ingredients were stirred together in a beaker at room temperature and then covered and placed in a covered container of boiling water for about 30 minutes, during which time the solutions were stirred again several times. The resulting clear and homogeneous agar solutions were then cooled to room temperature and allowed to rest for about 2 hours prior to gel strength measurements. The results are shown in TABLE V below. Surprisingly, the agar gel strength reduction, expected at higher pH values, and illustrated in FIG. 2, is not seen with the potassium borate salt buffer system.

TABLE V pH and Gel Strength values of agar gels containing various combinations of KNO2, $K_2B_4O_7$, and $K_2B_2O_4$

| Potassium Nitrite Conc., wt. % | Buffer | pH | Gel Strength, g/cm$^2$ |
|---|---|---|---|
| 0 | None | 7 | 1950 |
| 0.5 | None | 7 | 2160 |
| 0.5 | $K_2B_4O_7$ | 9.5 | 4350 |
| 0.5 | $KBO_2$ | 10.8 | 4550 |

Comparative Example 2

A dry powder mixture was made by thoroughly combining 8 grams of pure iron metal powder (Atmix 10 micron pure iron powder from Atmix Corporation, Hachinohe-shi, Aomori-ken, Japan) with 0.2 grams of powdered agar (TIC PRETESTED® Agar Agar 100). The resulting dry powder mixture was further combined with 0.8 grams of distilled water to yield a homogeneous damp powder mixture. This mixture was loaded into the mixing chamber of a small homemade screw-type mixer-extruder in which it was heated to approximately 100° C. for 5 minutes, and then further mixed and compounded by the shearing action of the rotating screw. The compounded mixture was then extruded directly from the mixing chamber forming a strand of about 2.5 mm diameter. The color of the freshly compounded and extruded mixture was steel gray, similar to that of the pure iron powder. The as-extruded steel gray strand was rubbery and resilient.

A portion of the strand was dried at about 90° C. for 20 minutes. Samples of the as-extruded (wet) and the dried strand were separately stored in small sealed glass containers at room temperature.

The color of the stored samples of the dried extrudate remained steel gray and did not change perceptively over a period of several months. In contrast, after 24 hours the color of the wet extrudate was significantly darker, turning to a dull black color after several days, indicative of a chemical reaction between the water and the iron particles. After three months of storage in the wet state, the wet strands had no resilience and had become brittle, probably due to loss of water to the oxidation reaction with the iron particles.

Example 1

An extruded strand was prepared from a molding composition as described in Comparative Example 2 except that the agar solution also contained 0.5 weight % potassium nitrite (Alpha Aesar CAS# 7758-09-0). The pH of this solution, as measured using a freshly calibrated Checker pH meter, was 7.00. A portion of the extruded strand was dried and both wet and dried portions were stored in small glass containers at room temperature. Again, the color of the freshly extruded mixture was steel gray and the texture was rubbery and resilient. In contrast to the result in Comparative Example 2, after three months of storage the color of the material stored in the wet state was unchanged as compared to its initial color or the color of the dried material. The wet stored material also retained a rubbery and resilient texture.

Example 2

An extruded strand was prepared from a molding composition as described in Comparative Example 2 except that the agar solution also contained 0.5 weight % potassium nitrite (Alpha Aesar CAS# 7758-09-0) and 0.5 weight % potassium tetraborate (Alpha Aesar CAS # 12045-78-2). The pH of this solution, as measured using a freshly calibrated Checker pH meter, was 9.2. A portion of the extruded strand was dried, and both wet and dried portions were stored in small glass containers at room temperature. The color of the freshly extruded mixture was steel gray and the texture was rubbery and resilient. After three months of storage, the color and texture of the material stored in the wet state were unchanged.

Example 3

An extruded strand was prepared from a molding composition as described in Comparative Example 2 except that the agar solution also contained 0.5 weight % potassium nitrite (Alpha Aesar CAS# 7758-09-0) and 0.5 weight % potassium metaborate (Alpha Aesar CAS # 16481-66-6). The pH of this solution measured using a freshly calibrated Checker pH meter, was 10.8. A portion of the extruded strand was dried, and both wet and dried portions were stored in small glass containers at room temperature. The color of the freshly extruded mixture was steel gray and the texture was rubbery and resilient. After three months of storage in the wet state, the color and texture of the material were unchanged.

Example 4

An extruded strand is prepared from a molding composition as described in Comparative Example 2 except that the agar solution also contained 0.4 weight % potassium nitrite (Alpha Aesar CAS# 7758-09-0), 0.1 wt. % potassium nitrate (Alpha Aesar CAS# 7757-79-1) and 0.5 weight % potassium tetraborate (Alpha Aesar CAS # 12045-78-2). The pH of this solution is about 9.5. A portion of the extruded strand is dried, and both wet and dried portions are stored in small glass containers at room temperature. The color of the freshly extruded mixture is steel gray and the texture is rubbery and resilient. After three months of storage in the wet state the color and texture of the material are expected to be unchanged.

Example 5

A dry powder mixture was made by thoroughly mixing 4000 grams of iron-2% nickel powder (Atmix P20F from Atmix Corporation, Hachinohe-shi, Aomori-ken, Japan) with 88.88 grams of powdered agar (TIC PRETESTED® Agar Agar 100) in a Paul O. Abbe, water jacket heated, 0.5 gallon capacity sigma-blade mixer running at about 20 rpm for 5 minutes at room temperature.

The manufacturer's specifications for the iron-2% nickel powder are shown in Tables VI and VII below.

TABLE VI

| Elemental Analysis | Wt. % |
|---|---|
| C | 0.46 |
| Si | 0.3 |
| Mn | 0.46 |
| P | 0.015 |
| S | 0.022 |
| Ni | 2.00 |
| Cr | 0.14 |
| O | 3200 PPM |

TABLE VII

| Particle Size | Wt. % |
|---|---|
| +30 micron | 0.46 |
| 30–20 micron | 16.5 |
| 20–10 micron | 28 |
| −10 micron | 55 |
| Weight Avg. | 9.17 |
| Particle Size | micron |
| Tap density | 4.95 g/cc |

A solution of 1.8 grams of potassium nitrite (Alpha Aesar CAS# 7758-09-0) and 1.8 grams of potassium tetraborate (Alpha Aesar CAS # 12045-78-2) in 400 cc of distilled water was then added to the sigma mixer gradually, and mixing was continued at 20 rpm for an additional 20 minutes, still at room temperature, producing a loose, damp powder mixture containing about 89 wt. % Fe—2Ni metal powder, 8.9 wt. % of the nitrite-borate solution, and 1.98 wt. % agar. The mixer water jacket temperature was then raised to about 89° C. over a period of 30 minutes, and held at this temperature for an additional 30 minutes while continuing to mix at 20 rpm. During heating, the temperature of the mixture rose to about 82° C. and the consistency of the mixture was altered from a loose powder to a high-viscosity fluid as the agar dissolved. The pH of the mixture was expected to be approximately 9.5 based on the borate content. The gel point temperature was about 400° C.

The blended mixture was then allowed to cool to 38° C., at which point it was shredded twice using the coarse grater attachment of a Hobart Kitchen Aid food processor. After shredding and cooling, the material had a rubbery texture. The moisture content measured after shredding, using an Arizona Instruments Computrac Moisture Analyzer, was 7.28 wt. %, somewhat below the targeted level of 8 wt. %. Two additional batches were compounded and shredded in the same way, except that additional water was added to compensate for evaporation losses. The three batches of shredded molding compound were blended together. The moisture content of the combined material was 8.22 wt. %. The material was placed in a tightly sealed plastic bucket. After 5 weeks of storage, the moisture content of material, its color and appearance, and its texture were unaltered.

The shredded and aged material was supplied to the hopper of a reciprocating screw Boy 22 ton injection molding machine. Several dozen standard tensile test bars (mold cavity dimensions: overall length 6.4", gauge section 2"×0.5"×0.125") were molded using screw rotation speed of 100 rev/min., barrel and nozzle temperature setpoints of 185° F. (85° C.), injection pressure in the range of 400–800 psi, and injection speed in the range of 1–2 inches per second. The mold temperature was maintained at 18° C.

The molded test bars, thus prepared, were air dried for 24 hours resulting in a stable residual moisture content of 0.4%. Thirteen of the bars were then sintered in a 2 cubic foot batch furnace (CM Furnaces, Inc) in an atmosphere of flowing hydrogen. The sintering schedule was as shown in Table VIII below.

TABLE VIII

| | |
|---|---|
| Ramp at 100° C./Hour to 600° C. | Hold for 4 Hours |
| Ramp at 100° C./Hour to 1149° C. | Hold for 1 Hours |
| Ramp at 100° C./Hour to 1360° C. | Hold for 3 Hours |
| Ramp at 100° C./Hour to Room Temperature | |

The width and thickness dimensions of the parts were measured before and after sintering in order to determine the sintering shrinkage. The sintering shrinkage in the width direction was 15.6% with an estimated standard deviation of 0.8%. The sintering shrinkage in the thickness direction was 15.6% with an estimated standard deviation of 0.7%.

The theoretical density of the Fe 2Ni alloy is approximately:

$$\rho_{theor.} = \text{wt. fraction Fe} \times \rho_{Fe} + \text{wt. fraction Ni} \times \rho_{Ni} = 0.98 \times 7.86\ g/cm^3 + 0.02 \times 8.90\ g/cm^3 = 7.88\ g/cm^3$$

The average density of the sintered test bars was 7.54 g/cc with an estimated standard deviation of 0.016 g/cm$^3$. The measured density represented about 95.7% of the theoretical density of the Fe 2Ni alloy.

One of the sintered test bars was sectioned, polished, and examined metallographically. The observed structure consisted of a homogenous continuous iron phase containing uniformly distributed 1–5 micron spherical voids. Etching with a standard 2% nital solution revealed equiaxed 30–50 micron grains with some of the distributed spherical voids lying on grain boundaries while others were positioned within the grains.

Six of the test bars were subjected to tensile strength and hardness testing. The average hardness was Rockwell B 90.8 with an estimated standard deviation of 1.2, the average ultimate tensile strength was 84.75 ksi (810 MPa) with an estimated standard deviation of 0.35 ksi (2.4 MPa), and the average elongation was 17.96% with an estimated standard deviation of 1.32%. These properties exceed the typical values for alloy MIM-4650 given by MPIF Standard 35 published by the Metal Powder Industry, Foundation.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A molding composition comprising:

a) at least one metal powder selected from the group consisting of elemental iron, an iron-base alloy containing less than 10 wt. % chromium, and an iron-based intermetallic compound; and b) a binder comprising a gel forming material, a solvent for said gel forming material; and at least one corrosion inhibiting compound selected from the group consisting of inorganic nitrates and inorganic nitrites.

2. The molding composition of claim 1, wherein said gel forming material is at least one member selected from the group consisting of agaroids, proteins, starches, methyl cellulose, polyvinyl alcohol, polyacrylamide, and polyvinyl pyrrolidone.

3. The molding composition of claim 1, wherein said gel forming material is an agaroid.

4. The molding composition of claim 1, wherein said gel forming material is an agar, agarose or a mixture thereof.

5. The molding composition of claim 1, wherein said gel forming material has a gel strength of at least about 200 g/cm$^2$ measured at a temperature of 23° C. on a gel comprising 1.5 wt % of the gel-forming material in 98.5 wt % solvent for said gel forming material.

6. The molding composition of claim 1, wherein said solvent for said gel forming material is at least 50 wt. % water.

7. The molding composition of claim 1, wherein said solvent for said gel forming material is at least 50 wt. % water additionally containing at least one member selected from the group consisting of methanol, ethanol, n-propanol, isopropanol, ethylene glycol, and glycerine.

8. The molding composition of claim 1, wherein said solvent for said gel forming material is at least 75 wt. % water.

9. The molding composition of claim 1, wherein said solvent for said gel forming material is at least 90 wt. % water.

10. The molding composition of claim 1, wherein said corrosion inhibiting compound is at least one member selected from the group consisting of the nitrate of lithium, sodium, potassium, calcium, magnesium, zinc, cobalt, iron, chromium, and copper, and the nitrite of lithium, sodium, potassium, calcium, magnesium, zinc, cobalt, iron, chromium, and copper.

11. The molding composition of claim 1, wherein said corrosion inhibiting compound is at least one member selected from the group consisting of the nitrite of lithium, sodium, potassium, calcium, magnesium, zinc, cobalt, iron, chromium, and copper.

12. The molding composition of claim 1, wherein the pH of said binder is from about 7 to about 11.

13. The molding composition of claim 1, wherein the pH of said binder is from about from 8.5 to about 9.5.

14. The molding composition of claim 1, additionally comprising at least one pH buffering compound selected from the group consisting of a borate salt of an alkali metal element, an alkali earth element, or ammonia.

15. The molding composition of claim 1, additionally comprising at least one pH buffering compound selected from the group consisting of the metaborate ($BO_2^-$) or tetraborate ($B_4O_7^{-2}$) salt of lithium, sodium, potassium, magnesium, calcium, strontium, barium, zinc, and ammonia.

16. The molding composition of claim 1, wherein said metal powder is from about 50 wt. % to about 96 wt. % of the molding composition.

17. The molding composition of claim 1, wherein said gel forming material is from about 0.2 wt % to about 5 wt % of the molding composition.

18. The molding composition of claim 1, wherein said corrosion inhibiting compound is from about 0.05 wt. % and about 5 wt. % of said binder.

19. The molding composition of claim 1, wherein said borate compound is from 0.05 wt. % to about 3.0 wt. % of said binder.

20. The molding composition of claim 1 further comprising at least one member selected from the group consisting of coupling agents, biocides, lubricants, fluidizing agents, and dispersants.

21. The molding composition of claim 1 further comprising a ceramic powder.

22. A process comprising the steps of:

a) injecting a molding composition selected from the group consisting of the molding composition recited in claim 1 and the molding composition recited in claim 14 into a mold at a temperature above the gel point of said gel-forming material;

b) cooling said molding composition in said mold to a temperature below the gel point of said gel-forming material to produce a self supporting molded article;

c) removing said article from said mold;

d) substantially removing said solvent from said molded article; and e) sintering said molded article in a protective atmosphere and under such conditions of time and temperature as are required to produce a final density greater than about 90% of the theoretical density.

23. A process comprising the steps of:

a) feeding a molding composition selected from the group consisting of the molding composition recited in claim 1 and the molding composition recited in claim 14 into an extruder;

b) extruding said molding composition through a shape forming die;

c) cooling at least the surface of said extrudate to a temperature below the gel point of said gel-forming material to produce a shaped article with at least a self supporting skin;

d) substantially removing said solvent from said shaped article; and e) sintering said shaped article in a protective atmosphere and under such conditions of time and temperature as are required to produce a final density greater than about 90% of the theoretical density.

24. A self supporting shaped article having the composition recited in claim 1 or the composition recited in claim 14.

25. A shaped article produced by the process of claim 22.

26. A shaped article produced by the process of claim 23.

* * * * *